US005437783A

United States Patent [19]

Cuthbert et al.

[11] Patent Number: 5,437,783

[45] Date of Patent: Aug. 1, 1995

[54] PROCESS FOR AROMATICS REDUCTION AND ENHANCED ISOPARAFFIN YIELD IN REFORMATE

[75] Inventors: Versie T. Cuthbert, Port Arthur; Ooriapadical C. Abraham, Nederland, both of Tex.

[73] Assignee: Texaco Inc., White Plains, N.Y.

[21] Appl. No.: 250,220

[22] Filed: Aug. 10, 1994

[51] Int. Cl.[6] ..... C10G 35/09

[52] U.S. Cl. ..... 208/139; 208/138; 208/141

[58] Field of Search ..... 208/63, 65, 66, 70, 208/137, 138, 139, 141

[56] References Cited

U.S. PATENT DOCUMENTS

| | | | |
|---|---|---|---|
| 4,964,975 | 10/1990 | Chao et al. | 208/139 |
| 4,969,990 | 11/1990 | Simpson | 208/216 PP |
| 5,106,800 | 4/1992 | Moser et al. | 208/139 |
| 5,135,639 | 8/1992 | Schmidt et al. | 208/66 |
| 5,135,902 | 8/1992 | Delaney et al. | 502/210 |
| 5,198,097 | 3/1993 | Bogdan et al. | 208/701 |
| 5,235,120 | 8/1993 | Bogdan et al. | 585/253 |

*Primary Examiner*—Asok Pal
*Assistant Examiner*—Bekir L. Yildirim
*Attorney, Agent, or Firm*—James L. Bailey; Kenneth R. Priem; Cynthia L. Hunter

[57] ABSTRACT

Disclosed is a reforming process for the production of gasoline having an increased isoparaffin yield, reduced aromatics content and a constant octane level which comprises passing the gasoline precursor containing greater than 20 vol% aromatics over a reforming catalyst comprising one or more metals from Group VIII and IVA of the Periodic Table on an oxide support, having a total pore volume of about 0.300 to 0.600 cc/g and greater than 85% of the pore volume in pores of diameter less than 100Å.

9 Claims, 3 Drawing Sheets

PROCESS FOR AROMATICS REDUCTION AND ENHANCED ISOPARAFFIN YIELD IN REFORMATE

FIELD OF THE INVENTION

This invention relates to the reduction of aromatics in the gasoline pool and, more particularly, this invention relates to the reduction of aromatics and benzene and improved production of isoparaffins employing a catalyst which effects these reactions but, unlike other available methods, does not cause a reduction in octane.

BACKGROUND OF THE INVENTION

During the lead reduction program in the last 15 years the principal source of increased gasoline octane was aromatics.

Aromatics content of gasoline is currently 30% or higher and it may contain more than 40% aromatics.

Recently, the Clean Air Act required the reduction of aromatics and benzene in the gasoline pool. CRU reformate is a major stream in the gasoline pool. Refineries are faced with the prospect of supplying reformulated gasoline to meet tightened automotive emission standards. Reformulated gasoline would differ from existing products in having a lower vapor pressure, lower final boiling point, increased content of oxygenates and lower content of olefins, benzene and aromatics. The aromatics content may be lowered over several years to a maximum of as low as 20%. Rising fuel quality demands of high-performance internal-combustion engines have compelled petroleum refineries to install new and modified processes for increased "octane" or knock resistance in the gasoline pool. A number of options have been used by refineries to accomplish this. Some methods include higher-severity catalytic cracking, higher fluid catalytic cracking gasoline octane, isomerization of light naphtha and the use of oxygenated compounds.

Unfortunately, increased reforming severity and higher FCC gasoline octane result in a higher aromatics content of the gasoline pool through the production of high-octane aromatics at the expense of low-octane heavy paraffins.

One method of reducing the content of environmentally undesirable aromatic-containing compounds is catalytic aromatic saturation. Several hydrotreating catalysts have been utilized for such operations. A typical catalyst contains hydrogenation metals supported on a porous refractory oxide. This method results in a reduction in octane as well as aromatics. The search continues for better ways to reduce aromatics with less reduction in octane.

U.S. Pat. No. 4,209,383 (Herout et al.) teaches a process combination for benzene reduction using catalytic reforming, catalytic cracking and alkylation of cracked light olefins with aromatics in the reformate.

U.S. Pat. No. 4,647,368 (McGuiness et al.) discloses a method for upgrading naphtha by hydrocracking over zeolite beta, recovering isobutane, $C_5$–$C_7$ isoparaffins and a higher boiling stream and reforming the latter stream.

In U.S. Pat. No. 5,200,059, to UOP, there is disclosed a process combination to reduce the aromatics content and increase the oxygen content of a key component of gasoline blends. The feedstock is contacted with a selective isoparaffin-synthesis catalyst in the presence of hydrogen to form a synthesis effluent with a higher isoparaffin/n-paraffin ratio, separating an isobutane-rich stream, dehydrogenating same and contacting with alcohol to obtain an ether.

U.S. Pat. No. 5,135,639 discloses a process combination to reduce the aromatic content of a key component of gasoline blends. Paraffins contained in catalytic reformates are conserved and upgraded by separation and isomerization, reducing the reforming severity required to achieve a given product. Light reformates may be separated and isomerized and heavier paraffins are separated from the reformate by solvent extraction and adsorption and isomerized.

In U.S. Pat. No. 5,135,902 there is disclosed a catalyst containing nickel, tungsten and phosphorous supported on an amorphous, porous refractory oxide having a narrow pore size distribution for converting hydrocarbon-containing feedstocks.

Another process combination to reduce the aromatics content and increase the oxygen content of a key component of gasoline is disclosed in U.S. Pat. No. 5,198,097. A naphtha feedstock having a boiling range usually suitable as catalytic reforming feed is processed by selective isoparaffin synthesis to yield lower-molecular weight hydrocarbons.

Of the proposed methods heretofore suggested for reducing aromatics a problem has been that a reduction in aromatics is usually accompanied by a decrease in octane.

Some of the more recent references cited above appear to be attempting to address the need in the art for a simple, effective method of reforming gasoline to reduce the amount of benzene and aromatics and increase yields of isoparaffins. None of the available references suggest the possibility of reducing aromatics while, at the same time, maintaining octane, although this would represent a distinct advance in the art.

SUMMARY OF THE INVENTION

It is an object of the present invention to provide an improved process for reformulating gasoline. A specific object is to produce gasoline containing higher yields of isoparaffins and reduced amounts of aromatics while maintaining a constant octane level.

The invention provides a process incorporating a catalyst, preferably containing platinum and tin, characterized by a total pore volume of about 0.300 to 0.600 cc/g, a median pore size of about 60–80Å, less than 15% of the total pore volume in pores of diameter >100Å, less 5% in pores >160Å, less than 2% in pores of diameter >200Å, less than 1% in pores of diameter greater than 500Å, and having greater than 85% in pores of diameter less than 100Å, which provides improved isoparaffin yield, reduced aromatics and reduced loss of octane.

DETAILED DESCRIPTION OF THE INVENTION

Figure 1:
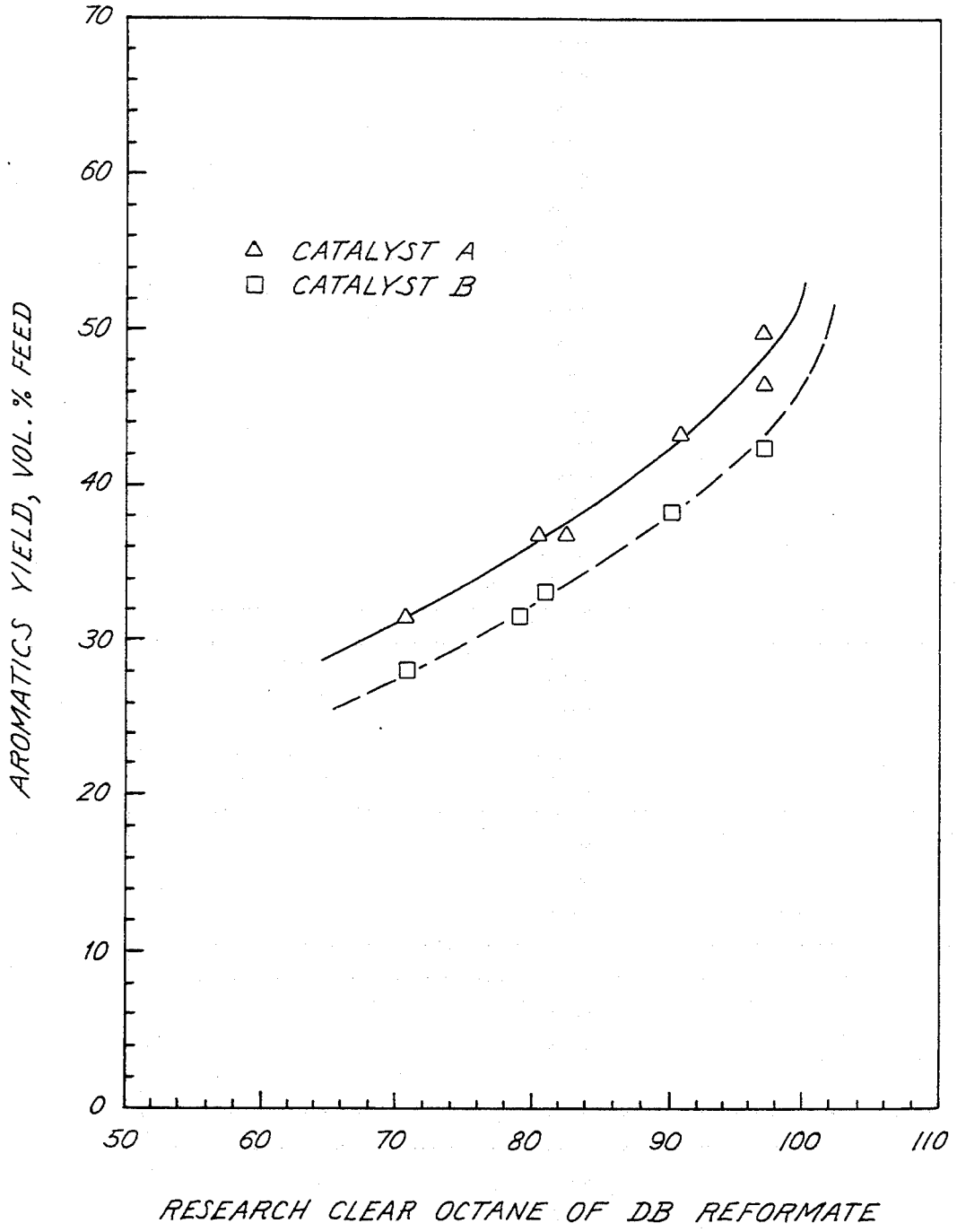
FIG. 1 is a graph which compares the yield of aromatics versus reformate octane for two catalysts, labeled A and B.

The invention is directed to a process for reformulating gasoline. A number of reforming processes are known in the art. Examples include processes described in U.S. Pat. No. 5,135,639, U.S. Pat. No. 5,198,097 and U.S. Pat. No. 5,200,059, incorporated herein by reference in their entirety. The process and catalyst of the instant invention could be employed in most reforming processes.

The naphtha feedstock used in the present process comprises paraffins, naphthenes and aromatics boiling within the gasoline range. Feedstocks may include straight run naphthas, natural gasoline, synthetic naphthas, thermal gasoline, catalytically cracked gasoline, partially reformed naphthas or raffinates from extraction of aromatics. Preferably the naphtha feedstock is relatively high boiling. A high boiling naphtha feedstock is converted in the selective isoparaffin synthesis step to obtain a greater proportion of naphtha into gasoline than if the feedstock were processed by catalytic reforming without selective isoparaffin synthesis.

A suitable reforming catalyst may comprise a dual-function composite containing a metallic hydrogenation-dehydrogenation component on a refractory support which provides acid sites for cracking and isomerization. The refractory support should be a porous, adsorptive, high-surface-area material which is uniform in composition without composition gradients of the species inherent to its composition. Within the scope of the present invention are refractory supports containing one or more of: (1) refractory inorganic oxides such as alumina, silica, titania, magnesia, zirconia, chromia, thoria, boria or mixtures thereof; (2) synthetically prepared or naturally occurring clays and silicates, which may be acid-treated; (3) crystalline zeolitic aluminosilicates, either naturally occurring or synthetically prepared in hydrogen form or in a form which has been exchanged with metal cations; (4) spinels such as $MgAl_2O_4$, $FeAl_2O_4$, $ZnAl_2O_4$, $CaAl_2O_4$; and (5) combinations of materials from one or more of these groups.

The catalyst may be formed into any shape or form of carrier material known to those skilled in the art such as spheres, extrudates, rods, pills, tablets or granules. In the instant examples spherical pellets were employed. Spherical pellets can be formed by rolling extrudates on a spinning disk.

An essential component of the first reforming catalyst is one or more Group VIII metals, with a platinum component being preferred. The platinum may exist within the catalyst as a compound such as an oxide, sulfide, halide, or oxyhalide, in chemical combination with one or more other ingredients of the catalytic composite, or as an elemental metal. Best results are obtained when substantially all of the platinum exists in the catalytic composite in a reduced state. The platinum component generally comprises from about 0.01 to 2 wt% of the catalytic composite, preferably 0.05 to 1 wt%, calculated on an elemental basis. It is within the scope of the present invention that the catalyst is combined with a metal known to modify the effect of the preferred platinum component. Such metal modifiers may include Group IVA metals, other Group VIII (8–10) metals, rhenium, indium, gallium, zinc, uranium, dysprosium, thallium and mixtures thereof. Excellent results are obtained when the reforming catalyst contains a tin component. Catalytically effective amounts of such metal modifiers may be incorporated into the catalyst by any means known in the art.

The reforming catalyst may also contain a halogen component. The halogen component may be either fluorine, chlorine, bromine or iodine or mixtures thereof. Chlorine is the preferred halogen component. The halogen component is generally present in a combined state with the inorganic-oxide support. The halogen component is preferably well dispersed throughout the catalyst and may comprise from more than 0.2 to about 15 wt% calculated on an elemental basis, of the final catalyst.

The naphtha feedstock may contact the reforming catalyst in either upflow, downflow or radial-flow mode.

The catalyst is contained in a fixed bed reactor or in a moving bed reactor whereby catalyst may be continuously withdrawn and added. These alternatives are associated with catalyst regeneration options known to those of ordinary skill in the art, such as: (1) a semiregenerative unit containing fixed bed reactors maintains operating severity by increasing temperature, eventually shutting the unit down for catalyst regeneration and reactivation; (2) a swing reactor unit, in which individual fixed-bed reactors are serially isolated by manifolding arrangements as the catalyst becomes deactivated and the catalyst in the isolated reactor is regenerated and reactivated while the other reactors remain on-stream; (3) continuous regeneration of catalyst withdrawn from a moving-bed reactor, with reactivation and substitution of the reactivated catalyst, permitting higher operating severity by maintaining high catalyst activity through regeneration cycles of a few days; or (4) a hybrid system with a semiregenerative and continuous-regeneration provisions in the same unit. The preferred embodiment of the present invention is a moving bed reactor with continuous catalyst regeneration.

A reforming catalyst within the scope of the instant invention would be characterized by a median pore size of about 70–75Å, with less than or equal to 15% of the total pore volume in pores of diameter greater than 100Å, less than or equal to 5% of pores greater than 160Å, less than or equal to 2% of pores greater than 200Å, and less than or equal to 1% of pores greater than 500Å.

The actual catalysts used in the instant invention are described in Tables 1 through 4. Table 1 lists weight percents of elements of the instant catalysts. The examples were carried out using two catalysts, labeled "A" and "B" with similar characteristics. The data indicates the pore volumes of "A" and "B" are equal. The surface area is similar. The significant difference was that catalyst "B" has more small pores. Catalyst "B" was prepared so as to have a very narrow pore size distribution. More detail data regarding the surface area, pore volume and pore structure of the two similar catalysts are listed in Table II.

The results exemplified herein which demonstrate improvements in production of isoparaffins and reduced aromatics, with no reduction in octane, were obtained using a catalyst characterized by about 88% of the total pore volume in pores of diameter less than 100Å; about 9% of the total pore volume in pores of diameter between 100Å and 160Å, for example 0.04 cc/g; about 1% or less of the total pore volume in pores of diameter between 160Å and 200Å, for example 0.004 cc/g; about 1% or less (0.0106) of the total pore volume in pores of diameters between 200Å and 500Å, for example, about 0.005 cc/g; and 1% or less (0.0063) of the total pore volume of diameter greater than 500Å, for example about 0.003 cc/g.

Within the scope of the instant invention is a catalyst characterized by 98% of the total pore volume in pores of diameter less than 160Å, 95% of the total pore volume in pores of diameter less than 100Å, less than about 1% of the total pore volume in pores of diameter greater than 200Å and less than 500Å, and minimal, for example, 0–0.7 percent of the pore volume in pores of diameter greater than 500Å.

It is preferred that there is a narrow pore size distribution for pores of diameter greater than the median pore diameter. The median pore diameter of the catalyst usually lies in the range of 50 to 100Å, preferably about 60Å to 80Å and most preferably about 70–75Å, say 73Å.

Other physical properties of the catalyst typically include a total pore volume of about 0.300 to 0.600 cc/g, preferably about 0.400 to 0.500 cc/g, and most preferably about 0.470 cc/g.

The catalyst may be in the form of pellets, tablets, extrudates, spheres or beads, however to maintain reproducible diffusivity within the formed catalyst-and reproducible pressure drop through the catalyst bed it is desirable to control the diameter of the formed catalyst within narrow limits. This is accomplished employing a caliper or dial gauge micrometer, calibrated in increments no larger than 0.001 inch to measure a random sample of the diameters of the formed catalyst, calculate the average value and report this value to the nearest 0.001 inch.

Prior to use of the catalyst pellets or other forms in the examples it is helpful to calculate density in terms of:

1. Loose density determined from maximum volume.
2. Settled density determined after the loose catalyst has stood undisturbed for 15 minutes.
3. Compacted density determined after the settled catalyst has been vibrated or tapped to a constant volume.

Procedures for manipulating the catalyst spheres or pellets in each case are known in the art and the density corresponding to the volume observed and recorded under various test conditions is calculated as follows:

$$\text{Density, lb/cu ft} = \frac{W}{V} \times 62.4$$

where $W$ = wt of sample, g
$V$ = volume of sample, ml

Practice of the process of this invention can be illustrated by the following example and data which is only intended as a means of illustration and it should be understood that the invention is not limited thereby. There are many other possible variations, as those of ordinary skill in the art will recognize, which are within the spirit of the invention.

EXAMPLE

The chargestock used in evaluating catalysts A and B was a hydrotreated straight run naphtha having the following properties.

| Test Results | Observed |
|---|---|
| Gravity, API | 60.4 ck 60.1 |

-continued

| Test Results | Observed |
|---|---|
| ASTM Distillation, °F. | |
| IBP/5 vol % | 186/209 |
| 10/20 | 216/223 |
| 30/40 | 231/240 |
| 50 | 250 |
| 60/70 | 260/271 |
| 80/90 | 283/302 |
| 95/EP | 319/349 |
| TBP Distillation, °F. | |
| IBP/5 | 132/156 |
| 10/20 | 179/206 |
| 30/40 | 216/241 |
| 50 | 254 |
| 60/70 | 267/285 |
| 80/90 | 300/323 |
| 95/EP | 343/412 |
| Reid Vapor Pressure @ 100° F., psi | 1.7 |
| Sulfur, Dohrmann, wppm | <0.5 |
| Nitrogen, Antek, wppm | 0.12 |
| Lead, wppb | NA |
| Copper, wppb | <1 |
| FIA-MS, vol % | 69.8 |
| Paraffins | 0.1 |
| Naphthenes | 18.8 |
| Aromatics | 11.3 |
| ASTM Octanes | |
| Research, Clear | 42.2 ck 40.0 |
| Motor, Clear | 45.0 ck 41.7 |

The naphtha chargestock was dried to less than 0.1 wppm water using a drier containing Davison 4A molecular sieve. After drying the charge was spiked with sufficient trichloroethane to obtain a 2.0 wppm concentration of chloride in the chargestock, which is added to maintain a nominal 1.0 wt% chloride content on the catalyst. The catalysts were dried at 400° F. for 4–6 hours prior to being loaded in the reactor. They were loaded under a dry nitrogen purge.

The catalysts were oxidized by setting the temperature at 200 psig and the dry air flow at 4.0 SCFH. The reactor temperature was increased to 900° F. at 100° F./hr in flowing air and held at 900° F. for about 1 hour to make sure the catalyst was oxidized. The reactor temperature was lowered to 700° F. and purged with nitrogen prior to reducing the catalyst with hydrogen.

The catalysts were then reduced. The reactor pressure was set at 500 psig and recycle operations were established using hydrogen. The reactor temperature was raised to 700° F. at 50° F./hr, while maintaining a recycle gas moisture content of less than 100 vppm. After the reactor inlet temperature was lined out, the temperature was held at 700° F. for four hours or until the unit passed the hot hydrogen pressure test. After the unit was pressure tested, the recycle gas was dried to less than 10 vppm water. Hydrogen was introduced and a rate of 1–2 SCFH was maintained prior to cutting in charge to the unit at 700° F. After charge was introduced the reactor was increased from 700° F. to 800° F. at 50° F./hr maximum while maintaining a recycle gas moisture content of 35 vppm or less. The reactor temperature was further increased to the first test period conditions (890° F.) at 30° F./hr while continuing to hold the recycle moisture content below 35 vppm. Hydrogen makeup gas was then cut out and the run was begun. The moisture content of the recycle gas was held below 30 vppm at temperatures above 900° F.

Figure 2:
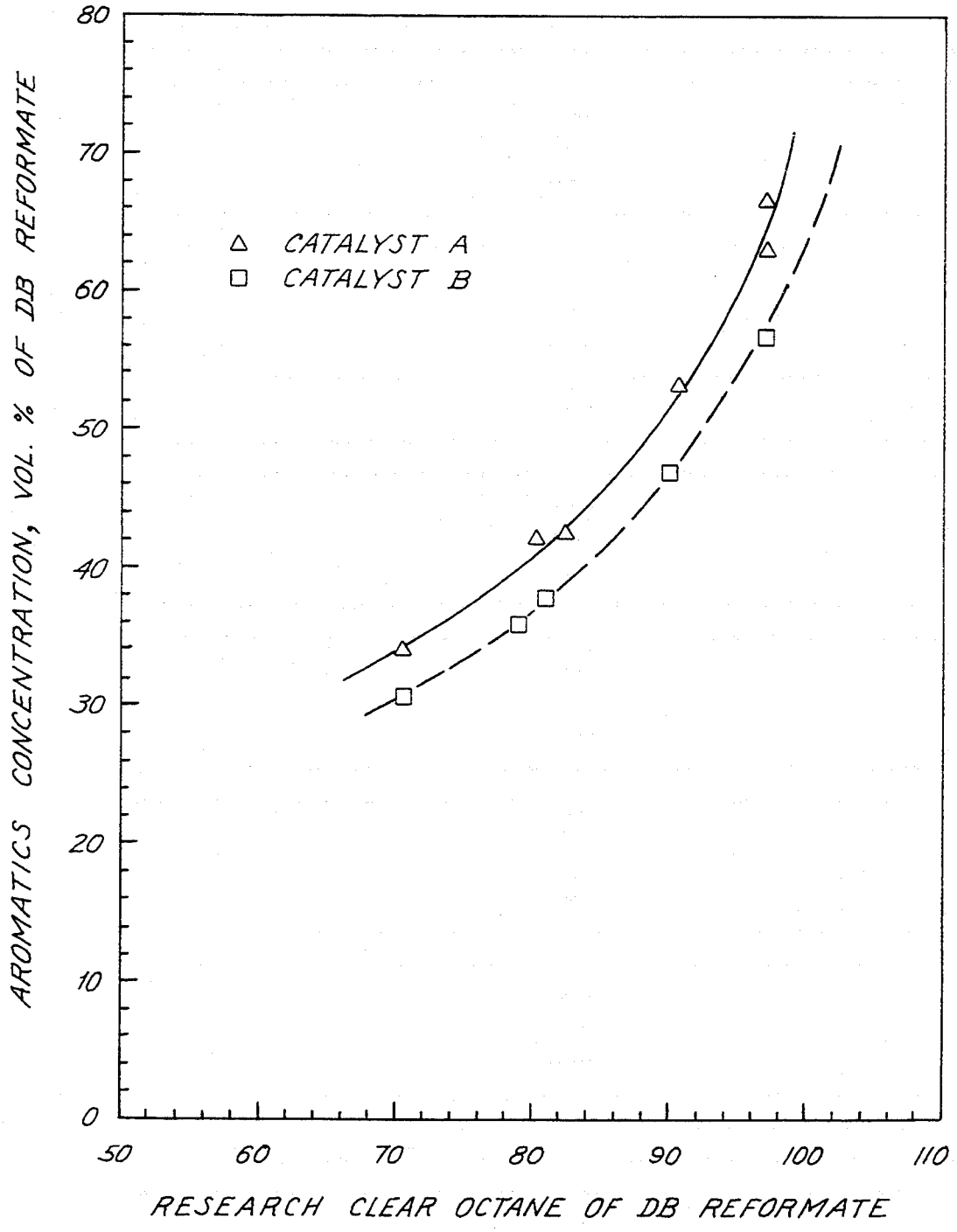
FIG. 2 is a graph which compares the concentration of aromatics versus the reformate octane for both Catalyst A and B.
Figure 3:
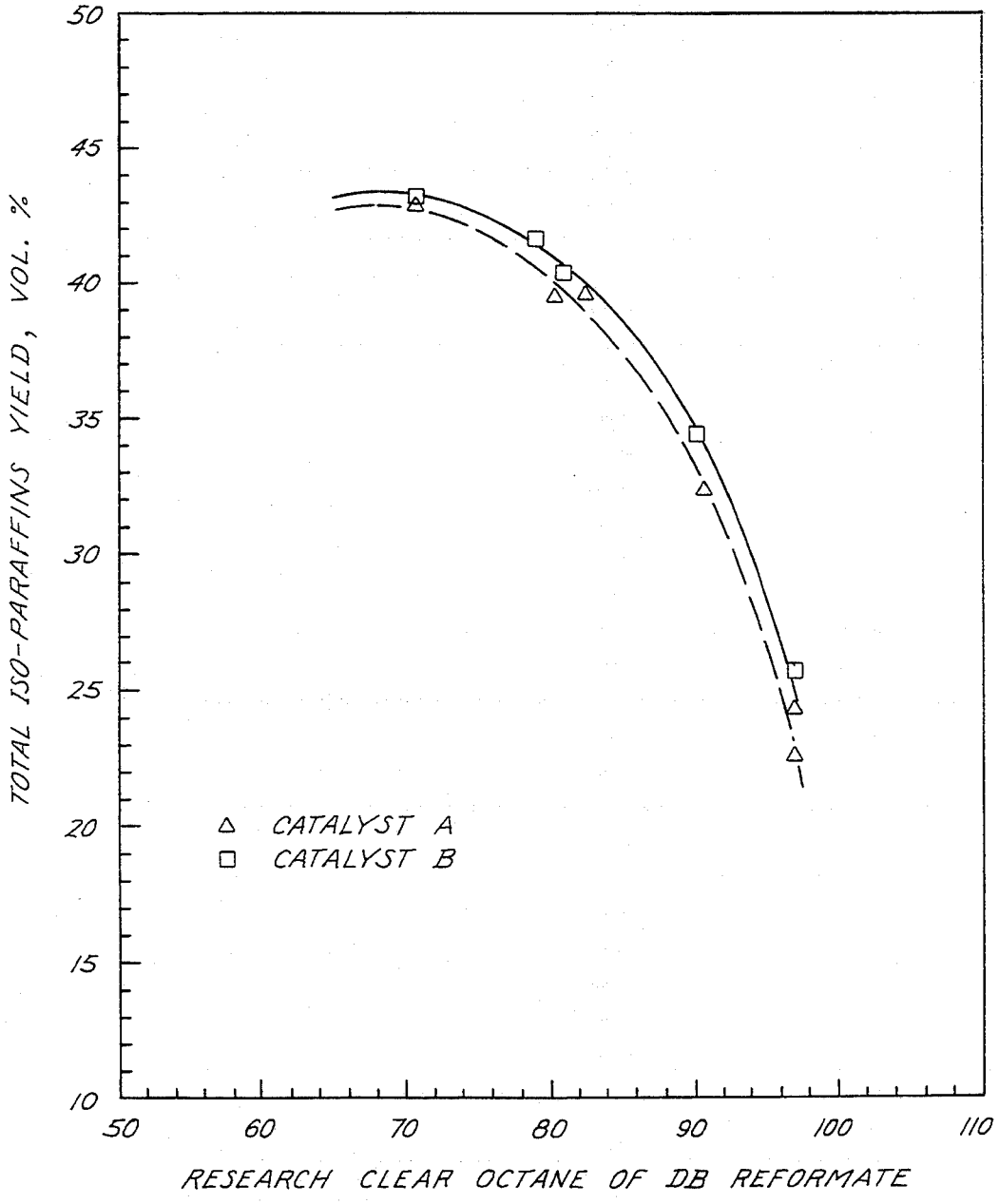
FIG. 3 is a graph which compares the yield in vol% of isoparaffins versus reformate octane.

Test results on this chargestock are shown in FIGS. 1 through 3. FIGS. 1 and 2 demonstrate that the aromatics yield and concentration are higher for Catalyst A at a constant octane level.

FIG. 3 shows the yield of isoparaffins for each catalyst. The total isoparaffin yields are lower for Catalyst A than Catalyst B at a constant octane level.

Catalyst B, having a similar surface area, pore volume, and pore distributions, has more pores <100Å and produces a product containing less aromatics and more isoparaffins for constant octane level.

TABLE 1

FRESH CATALYST TEST RESULTS

| Manufacturer | Catalyst A | Catalyst B |
|---|---|---|
| Form | Spheres | Spheres |
| Test Results | | |
| Average Diameter, in. | 0.074 | 0.0652 |
| Compacted Bulk Density, lb/ft$^3$ | 35.7 | 36.2 |
| Abrasion Coefficient | 0.01 | 0.02 |
| Platinum Content, wt % | 0.375* | 0.37* |
| Tin Content, wt % | 0.38* | 0.30* |
| Platinum Crystal Size, A | 42 | 16 |
| Chloride Content, wt % | 1.07 | 1.0 |
| LECO Carbon, wt % | 0.07 | 0.02 |
| LECO Sulfur, wt % | 0.01 | <0.01 |

*Manufacturer's Specification

TABLE 2

Surface Area, Pore Volume and Pore Structure of Selected Reforming Catalysts

| Catalyst Code / Catalyst Designation | A | B |
|---|---|---|
| Nitrogen Adsorption | | |
| Pore Size, Dist., (cc/g) | | |
| TPV | 0.812 | 0.470 |
| >500A | 0.000 | 0.003 |
| >200A | 0.073 | 0.009 |
| >160A | 0.418 | 0.013 |
| >100A | 0.744 | 0.056 |
| <100A | 0.068 | 0.414 |
| Desorption Ave. Pore Dia., A | 133 | 73 |
| Calculated Pore Mode, A | 162 | 74 |

TABLE 2-continued

Surface Area, Pore Volume and Pore Structure of Selected Reforming Catalysts

| Catalyst Code / Catalyst Designation | A | B |
|---|---|---|
| Multi-Point BET | 182 | 181 |
| Surface Area (m$^2$/g) | 182 | 181 |
| Desorption Pore Vol. (cc/g) | 0.80* | 0.80* |

*Manufacturer's Data

Table III provides specific mercury autopore data regarding the pore distribution of Catalysts "A" and "B".

TABLE 3

| Pore Diameter mL/9 | CUMULATIVE VOLUME mL/g Catalyst A | CUMULATIVE VOLUME mL/g Catalyst B | INCREMENTAL VOLUME mL/g Catalyst A | INCREMENTAL VOLUME mL/g Catalyst B | % OF TOTAL INTRUSION VOLUME Catalyst A | % OF TOTAL INTRUSION VOLUME Catalyst B |
|---|---|---|---|---|---|---|
| 40 | 0.81 | 0.75 | 0.0026 | 0.0020 | 0.32 | 0.27 |
| 50 | 0.81 | 0.75 | 0.0050 | 0.0091 | 0.62 | 1.22 |
| 60 | 0.80 | 0.74 | 0.0097 | 0.0510 | 1.20 | 6.82 |
| 70 | 0.79 | 0.69 | 0.0137 | 0.5450 | 1.69 | 72.88 |
| 80 | 0.78 | 0.14 | 0.0208 | 0.1035 | 2.56 | 13.84 |
| 90 | 0.76 | 0.04 | 0.0256 | 0.0070 | 3.16 | 0.94 |
| 100 | 0.73 | 0.03 | 0.0337 | 0.0042 | 4.15 | 0.56 |
| 110 | 0.70 | 0.03 | 0.0452 | 0.0026 | 5.57 | 0.35 |
| 120 | 0.66 | 0.02 | 0.0735 | 0.0017 | 9.05 | 0.23 |
| 130 | 0.58 | 0.02 | 0.1111 | 0.0020 | 13.69 | 0.27 |
| 140 | 0.47 | 0.02 | 0.1251 | 0.0007 | 15.42 | 0.09 |
| 150 | 0.35 | 0.02 | 0.1287 | 0.0189 | 15.85 | 0.17 |
| 160 | 0.22 | 0.02 | 0.1779 | 0.0037 | 21.92 | 0.50 |
| 200 | 0.04 | 0.02 | 0.0240 | 0.0073 | 2.95 | 0.99 |
| 500 | 0.02 | 0.01 | 0.0088 | 0.0041 | 1.09 | 0.54 |
| 1500 | 0.006 | 0.002 | 0.0061 | 0.0024 | 0.76 | 0.33 |

| | Catalyst A | Catalyst B |
|---|---|---|
| Total Intrusion Volume | 0.8119 mL/g | 0.7478 mL/g |
| Total Pore Area | 238.614 sq-m/g | 388.574 sq-m/g |
| Median Pore Diameter, vol | 0.0145 | 0.0074 |
| Median Pore Diameter (Area) | 0.0138 | 0.0074 |
| Average Pore Diameter (4V/A) | 0.0136 | 0.0077 |
| Bulk Density | 0.8812 g/mL | 0.9428 g/mL |
| Apparent (Skeletal) Density | 3.0974 g/mL | 3.1968 g/mL |
| Porosity | 71.55% | 70.51% |
| Stem Volume Used | 59.0% | 64.0% |

TABLE 4

NITROGEN DESORPTION

| PORE DIAMETER cc/g | CUMULATIVE VOLUME cc/g | | INCREMENTAL VOLUME cc/g | |
|---|---|---|---|---|
| 40 | 0.808942 | 0.465154 | 0.002275 | 0.004613 |
| 50 | 0.803565 | 0.454471 | 0.003809 | 0.009115 |
| 60 | 0.795043 | 0.431660 | 0.005599 | 0.013940 |
| 70 | 0.782645 | 0.007745 | 0.007745 | 0.060011 |
| 80 | 0.765938 | 0.248325 | 0.009425 | 0.071714 |
| 90 | 0.745709 | 0.114538 | 0.012375 | 0.042066 |
| 100 | 0.719614 | 0.055489 | 0.014701 | 0.009018 |
| 110 | 0.689610 | 0.040310 | 0.016118 | 0.006048 |
| 120 | 0.657092 | 0.029054 | 0.017044 | 0.003886 |
| 130 | 0.621612 | 0.021804 | 0.019487 | 0.002615 |
| 140 | 0.579529 | 0.017201 | 0.026808 | 0.001689 |
| 150 | 0.520854 | 0.014178 | 0.037569 | 0.000999 |
| 160 | 0.437309 | 0.012291 | 0.057491 | 0.000769 |
| 170 | 0.321573 | 0.010902 | 0.049770 | 0.000541 |
| 180 | 0.226778 | 0.009856 | 0.042442 | 0.000445 |
| 190 | 0.144850 | 0.009043 | 0.036229 | 0.000296 |
| 200 | 0.075916 | 0.008471 | 0.027978 | 0.000258 |
| 300 | 0.047938 | 0.008213 | 0.045167 | 0.002804 |
| 400 | 0.002771 | 0.005409 | 0.000901 | 0.001406 |
| 500 | 0.001870 | 0.004003 | 0.000658 | 0.001062 |
| 600 | 0.001212 | 0.002941 | 0.000364 | 0.000869 |
| 700 | 0.000848 | 0.002072 | 0.000256 | 0.000735 |
| 800 | 0.000592 | 0.001337 | 0.000222 | 0.000637 |
| 900 | 0.000370 | 0.000700 | 0.000195 | 0.000562 |

TABLE 4-continued

| NITROGEN DESORPTION | | | | |
|---|---|---|---|---|
| 1000 | 0.000175 | 0.000138 | 0.000175 | 0.000138 |
| | | Catalyst A | | Catalyst B |
| Cumulative Desorption Area | | | | |
| Surface Area of Pores | | 243.8961 sq m/g | | 256.7276 sq m/g |
| Cumulative Desorption Pore | | | | |
| Volume of Pores Between 17.00 and 3000.00A Diameter | | 0.811730 cc/g | | 0.469663 cc/g |
| Average Pore Diameter (4V/A) | | 178.2496 A | | 102.7485 A |

What is claimed is:

1. In a reforming process for the production of a gasoline component from naphtha feedstock comprising:

(a) contacting the naphtha feedstock containing above 20 mol% aromatics in a reforming zone at reforming conditions with a reforming catalyst comprising one or more metals from Group VIII and IVA of the Periodic Table, optionally on a support, to produce a reformate and a hydrogen-rich gas, the improvement which provides reduced aromatics by isomerization to isoparaffins, improved isoparaffin yield, and reduced loss of octane which comprises, (b) contacting said naphtha with said catalyst further characterized by a total pore volume of about 0.300 to 0.600 cc/g, a median pore size of about 60–80Å, less than 1% in pores of diameter greater than 500Å, and greater than 85% in pores of diameter less than 100Å, and producing said gasoline component.

2. The process of claim 1 wherein the reforming catalyst is selected from one or more metals from the group consisting of iron, ruthenium, osmium, cobalt, rhodium, iridium, nickel, palladium and platinum.

3. The process of claim 1 wherein the reforming catalyst also contains one or more Group IVA metals selected from the group consisting of carbon, silicon, germanium and tin.

4. The process of claim 1 wherein the catalyst contains 0.30 to 0.45 wt% platinum, 0.25 to 0.45 wt% tin, 0.5 to 2.0 wt% chloride, and less than 0.1 wt% carbon and sulfur.

5. The process of claim 1 wherein the catalyst is on a support which comprises a refractory inorganic oxide selected from the group consisting of alumina and silica.

6. The process of claim 1 wherein the total pore volume of said catalyst is 0.400 to 0.500 cc/g.

7. The process of claim 1 wherein the median pore size is about 70–75Å.

8. In a reforming process for the production of a gasoline component from naphtha feedstock which comprises:

(a) contacting the naphtha feedstock containing greater than 20 mol% aromatics in a reforming zone at reforming conditions with a reforming catalyst comprising one or more metals from Group VIII and IVA of the Periodic Table, optionally on a refractory support, to produce a reformate and a hydrogen-rich gas, the improvement which provides improved isoparaffin yield, reduced aromatics and reduced loss of octane which comprises (b) contacting said naphtha with said reforming catalyst, further characterized by: a total pore volume of about 0.400 to 0.500 cc/g, a median pore size of about 70–75Å; less than or equal to 15% of pores greater than 100Å; less or equal to 5% of pores greater than 160Å; less than or equal to 2% of pores greater than 200Å; less than 1% of pores greater than 500Å and producing said gasoline component.

9. The process of claim 1 wherein less than 2% of the total pore volume is in pores of >200Å.

* * * * *